US005244403A

United States Patent [19]

Smith et al.

[11] Patent Number: 5,244,403

[45] Date of Patent: Sep. 14, 1993

[54] ELECTRONIC COMPONENT SOCKET WITH EXTERNAL LATCH

[75] Inventors: Gregory J. Smith, North Attleboro; Wayne S. Alden, Whitman; Mark E. Lewis, Mansfield; Michael J. Bellomo, Millis, all of Mass.

[73] Assignee: Augat Inc., Mansfield, Mass.

[21] Appl. No.: 908,846

[22] Filed: Jul. 1, 1992

Related U.S. Application Data

[63] Continuation of Ser. No. 683,322, Apr. 10, 1991, abandoned.

[51] Int. Cl.[5] ..... H01R 13/00

[52] U.S. Cl. ..... 439/326

[58] Field of Search ..... 439/296, 326, 629-637

[56] References Cited

U.S. PATENT DOCUMENTS

| | | | |
|---|---|---|---|
| 3,246,279 | 4/1966 | Storcel | 339/17 |
| 3,710,303 | 1/1973 | Gallager, Jr. | 339/61 M |
| 3,718,895 | 2/1973 | Reynolds et al. | 339/258 R |
| 3,784,955 | 1/1974 | Reynolds et al. | 339/17 R |
| 3,803,533 | 4/1974 | Taplin | 339/91 |
| 3,920,303 | 11/1975 | Pittman et al. | 339/91 R |
| 4,080,037 | 3/1978 | Kunkle et al. | 339/258 R |
| 4,128,289 | 12/1978 | Occhipinti | 339/75 MP |
| 4,129,351 | 12/1978 | Sugimoto et al. | 339/176 MP |
| 4,136,917 | 1/1979 | Then et al. | 439/326 |
| 4,145,103 | 3/1979 | Knowles | 339/99 R |
| 4,188,083 | 2/1980 | Knowles | 339/99 R |
| 4,362,353 | 12/1982 | Cobaugh et al. | 339/258 P |
| 4,384,757 | 5/1983 | Andrews, Jr. et al. | 339/258 R |
| 4,575,172 | 3/1986 | Walse et al. | 339/75 MP |
| 4,589,794 | 5/1986 | Sugiura et al. | 403/187 |
| 4,656,605 | 4/1987 | Clayton | 365/52 |
| 4,693,533 | 9/1987 | Szczesny et al. | 439/350 |
| 4,709,302 | 11/1987 | Jordan et al. | 361/388 |
| 4,713,013 | 12/1987 | Regnier et al. | 439/326 |
| 4,722,700 | 2/1988 | Kuhn et al. | 439/629 |
| 4,725,250 | 2/1988 | Kuhn et al. | 439/629 |
| 4,726,783 | 2/1988 | Nakazawa et al. | 439/350 |
| 4,727,513 | 2/1988 | Clayton | 365/52 |
| 4,735,583 | 4/1988 | Rudy, Jr. et al. | 439/350 |
| 4,737,120 | 4/1988 | Grabbe et al. | 439/326 |
| 4,756,694 | 7/1988 | Billman et al. | 439/61 |
| 4,781,612 | 11/1988 | Thrush | 439/328 |

(List continued on next page.)

FOREIGN PATENT DOCUMENTS

| | | |
|---|---|---|
| 093510 | 4/1983 | European Pat. Off. . |
| 277873 | 1/1988 | European Pat. Off. . |

OTHER PUBLICATIONS

Meyer, G. E., "Spring Retainer for Retention of Cable Connector," *IBM Technical Disclosure Bulletin*, vol. 20 No. 5, Oct. 1977, pp. 1887-1888.

Specification sheet for Augat 3900 Series Latch, Augat Inc., Attleboro Falls, Mass. 02763 (1991).

Specification sheet for Molex SIMM* Socket 78810 Series, Molex Incorporated, Lisle, Illinois 60532 (Revised Feb. 1985).

Molex SIMM* Socket Technology Handbook, Molex Incorporated, Lisle, Illinois 60532.

*Primary Examiner*—Joseph H. McGlynn

*Attorney, Agent, or Firm*—Weingarten, Schurgin, Gagnebin & Hayes

[57] ABSTRACT

The invention provides a socket for substrates such as single in-line memory modules, circuit boards, and similar components which are inserted into and rotated into fixed position on the socket. The socket housing includes end portions having improved structural integrity for externally mounting cooperative latch elements. The external mounting permits a greater variety of latch sizes and configurations to suit operational requirements. An exemplary latch is preferably metal and comprises a mounting collar having a compliant C-section which corresponds to a latch-receiving section or member on the socket housing, a detent for clasping a memory module, and a resilient section connected therebetween for biasing the detent so that it clasps the memory module in fixed position in the socket. The latch collar is mounted onto the cooperative section of the socket end portion, and the latch is thereby disposed exteriorly on the socket body.

41 Claims, 12 Drawing Sheets

U.S. PATENT DOCUMENTS

| | | | |
|---|---|---|---|
| 4,826,446 | 5/1989 | Junwait | 439/326 |
| 4,850,891 | 7/1989 | Walkup et al. | 439/326 |
| 4,850,892 | 7/1989 | Clayton et al. | 439/326 |
| 4,898,540 | 2/1990 | Saito | 439/153 |
| 4,929,194 | 5/1990 | Korsunsky et al. | 439/571 |
| 4,946,403 | 8/1990 | Billman et al. | 439/326 |
| 4,986,765 | 1/1991 | Korsunsky et al. | 439/326 |
| 4,995,825 | 2/1991 | Korsunsky et al. | 439/326 |
| 5,004,429 | 4/1991 | Yagi et al. | 439/326 |
| 5,009,611 | 4/1991 | Regnier | 439/326 |
| 5,013,257 | 5/1991 | Korsunsky et al. | 439/326 |
| 5,015,196 | 5/1991 | Yamada | 439/326 |
| 5,094,624 | 3/1992 | Bakke et al. | 439/326 |

30
33
32
36
35
34
70
16
16
13
27
24
75
25
52
41
12
17
80
22
43
40
50
18
44

ELECTRONIC COMPONENT SOCKET WITH EXTERNAL LATCH

This application is a continuation of application Ser. No. 07/683,322, filed Apr. 10, 1991, now abandoned.

FIELD OF THE INVENTION

This invention relates to electronic component sockets, and more particularly to a socket for single in-line memory modules and like components.

BACKGROUND OF THE INVENTION

Electronic component sockets are known for mounting single in-line memory modules. A memory module generally comprises a circuit board having a plurality of electronic memory devices mounted thereon and having a linear array of contact pads along an edge of the circuit board. The circuit board is installed in the socket by insertion of the contact end of the board into a cooperative groove in the socket body containing an array of electrical contacts which are matable with the contact pads of the circuit board. The circuit board is rotated into engagement with a pair of latches which are disposed at respective ends of the socket body and operative to retain the circuit board within the socket body and the electrical contacts of the socket in mating engagement with the contact pads of the circuit board.

Memory module sockets and similar sockets in which a circuit board is inserted and rotated into a locked position are shown for example in U.S. Pat. Nos. 3,920,303; 4,128,289; 4,136,917; 4,575,172; 4,713,013; and 4,850,892.

Memory module sockets having plastic latches integrally formed with the socket body are shown in U.S. Pat. Nos. 4,850,891 and 4,850,892. Memory module sockets having metal latches are shown in U.S. Pat. Nos. 4,986,765 and 4,995,825. The metal latches disclosed therein are retained within cooperative latch receiving openings or pockets at respective ends of a socket body or housing. The size and configuration of the metal latches disposable within a cooperative opening are limited by the presence and necessity of the openings. Moreover, the internally mounted metal latches require elements to retain the latches within the mounting openings, such as a securing arm, as shown in U.S. Pat. No. 4,986,765, or an outwardly formed barb, as shown in U.S. Pat. No. 4,995,825. The necessity for the mounting opening or pocket also limits the strength and solidity of the socket body, because the socket body is deprived of structural integrity by the opening.

SUMMARY OF THE INVENTION

The invention provides a socket for substrates such as single in-line memory modules, circuit boards, and similar components which are inserted into and rotated into fixed position on the socket. The socket housing includes end portions having improved structural integrity for externally mounting cooperative latch elements. External mounting permits a greater variety of latch sizes and configurations to suit operational requirements.

The end portions of the socket housing include respective latch-receiving sections or members for externally mounting cooperative latches. The end portions may also contain abutment structures to prevent the latches, which are preferably made of resilient material such as metal, from bending when a memory module or like component is urged into latched position. The end portions may also provide a substantially nonresilient base on which to mount or form male keys and female keyways for side-by-side coupling or mounting of two or more component sockets of like configuration.

An exemplary latch comprises a mounting member such as a collar with a compliant C-section corresponding to the latch-receiving section or member on the socket housing, a detent for clasping a memory module, and a resilient section connected therebetween for biasing the detent against a memory module. The collar is mounted onto the cooperative area of the end portion, and the latch is thereby disposed exteriorly on the socket body.

DESCRIPTION OF THE DRAWINGS

The invention will be more fully understood from the following detailed description taken in conjunction with the accompanying drawings in which.

DETAILED DESCRIPTION OF THE INVENTION

Reference is made to the drawings, wherein like numerals correspond throughout to like features. There are shown exemplary embodiments of an electronic component socket 10 of the invention configured for receiving a single in-line memory module (SIMM) and like components. The socket 10, mounted upon a substrate or circuit board 80, is shown retaining a memory module 70, circuit board, or like component in fixed position.

Figure 1:
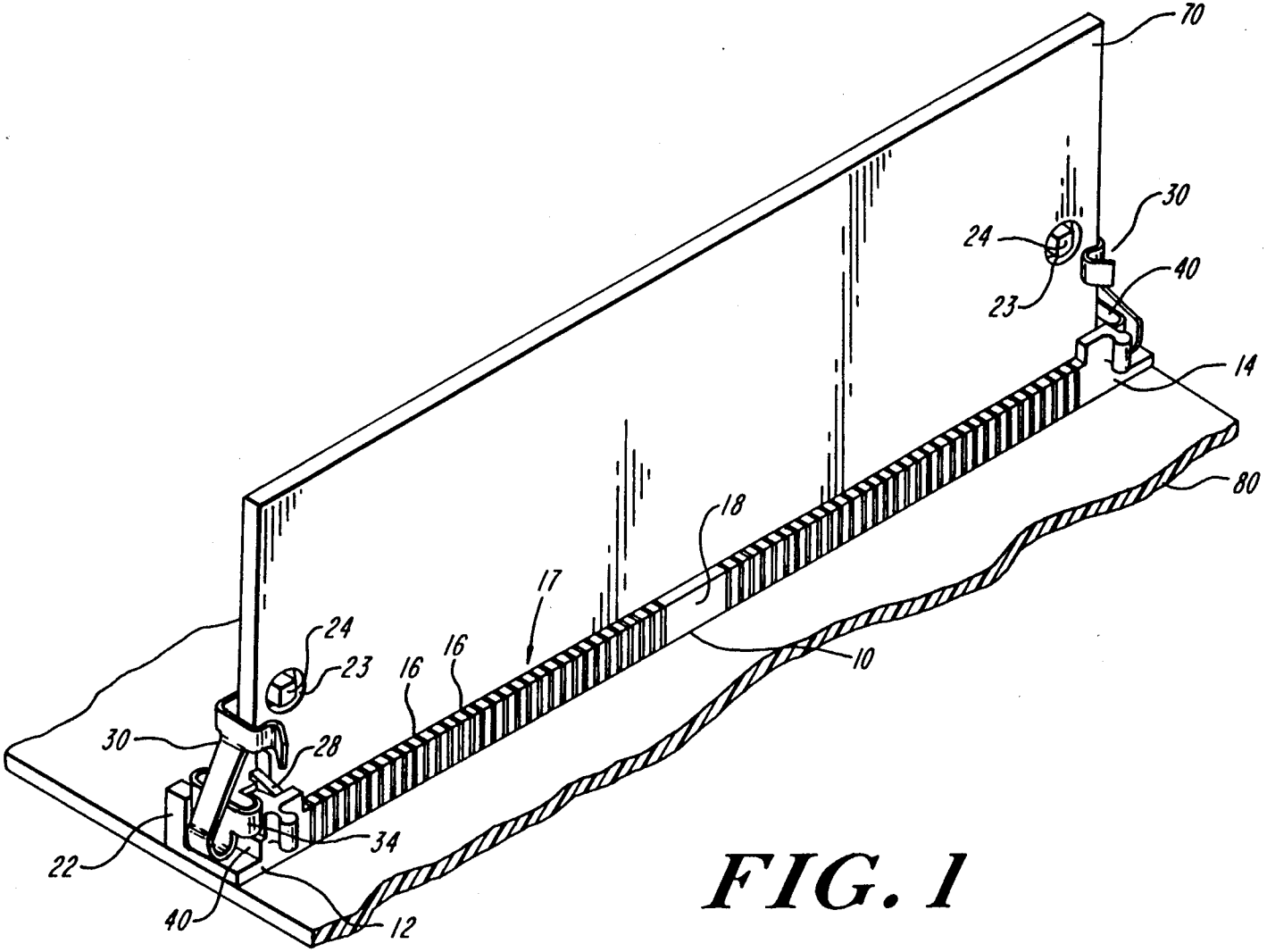
FIG. 1 is a pictorial view of an electronic component socket of the invention with a circuit board secured thereon.
Figure 2:
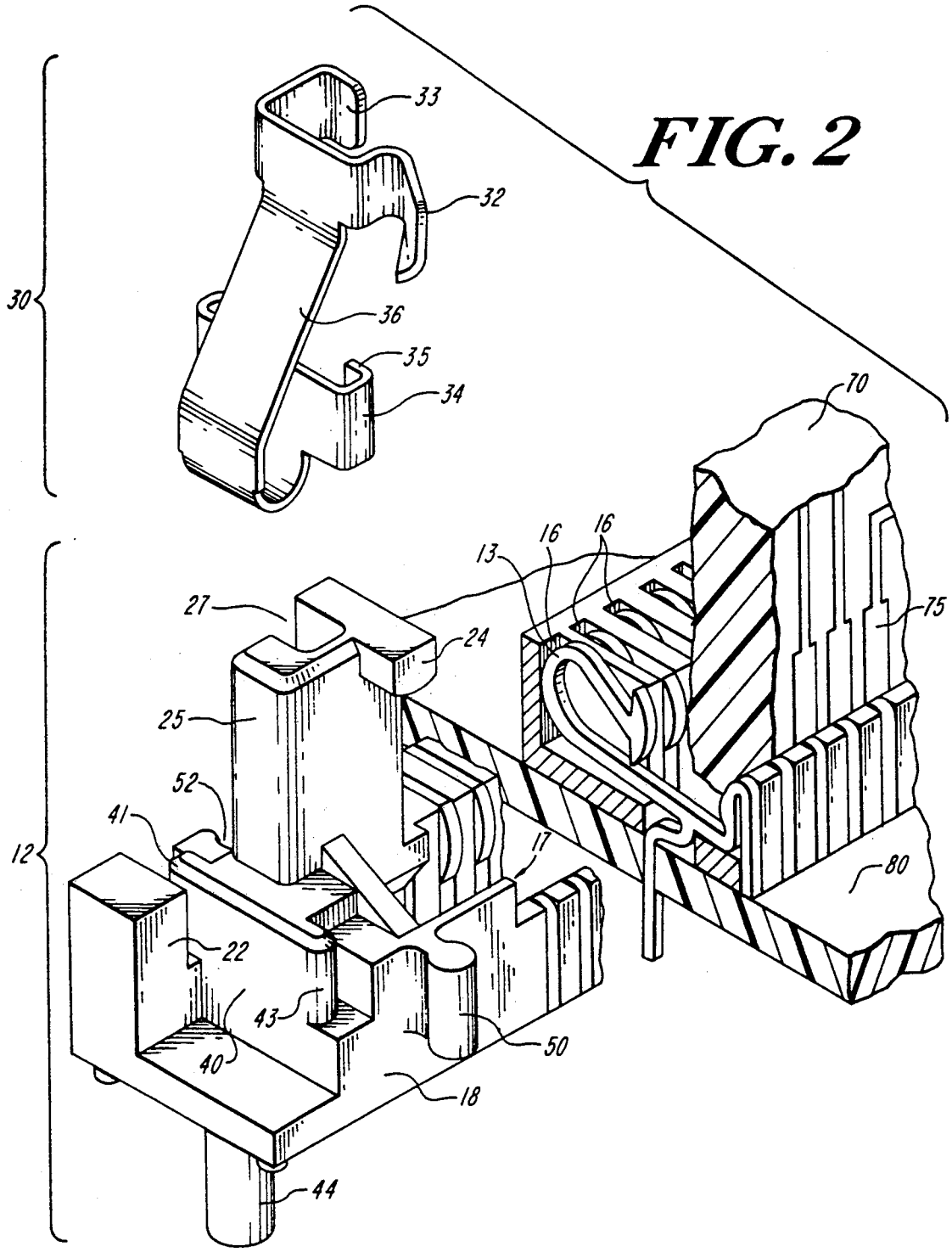
FIG. 2 is an exploded view showing a socket end portion, associated latch and circuit board of FIG. 1.
Figure 3:
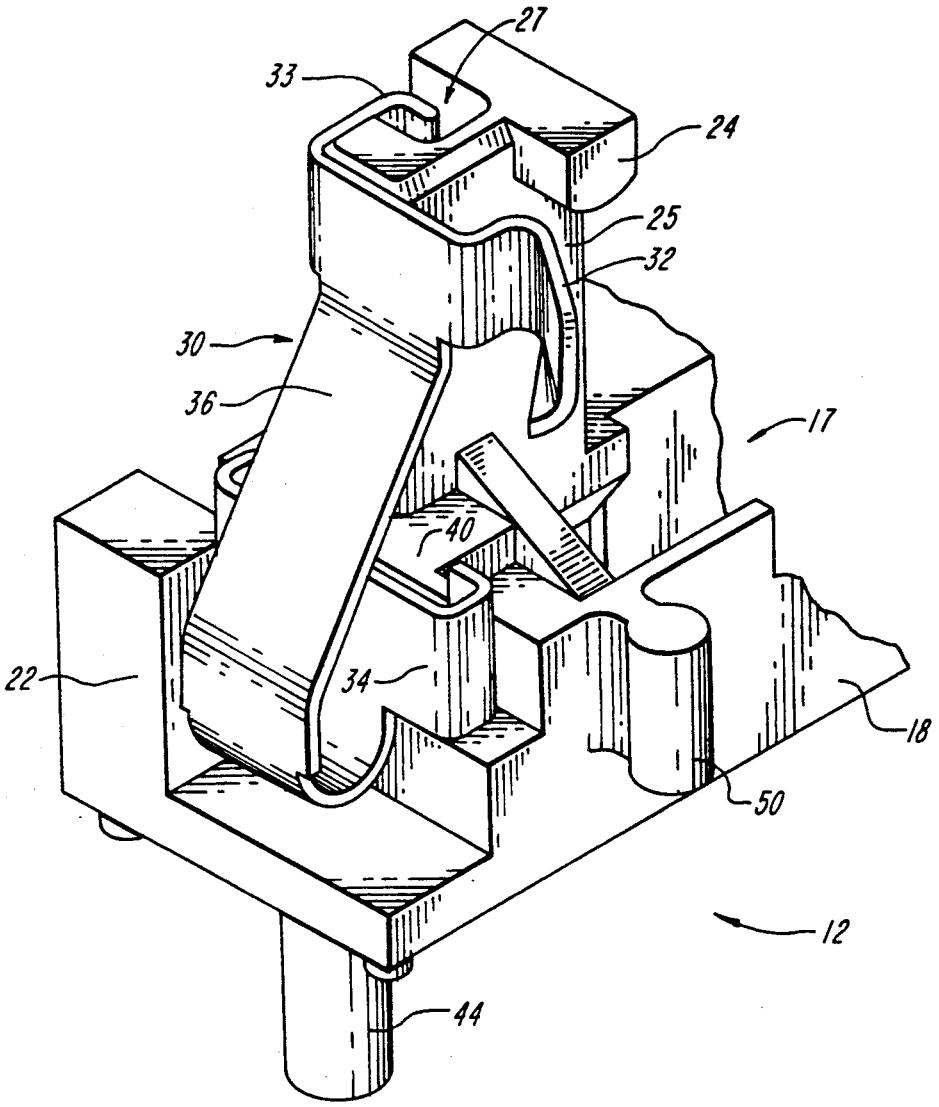
FIG. 3 is a perspective view of the housing socket end portion and associated latch of FIG. 2 in combination.

An exemplary socket 10, as shown in FIG. 1, is comprised of an insulative housing 18 having a substantially rigid and nonresilient first end portion 12 and second end portion 14. The insulative housing 18 is preferably formed from a suitable plastic material. A groove 17, located between end portions 12 and 14, intersects spaced-apart slots 16 located on the socket housing 18. As shown in FIG. 2, each slot 16 typically contains an electrical contact 13. The electrical contacts 13 correspond to electrical contacts 75 of the memory module 70 inserted into the groove 18 on the socket housing 18 and rotated into fixed position. End portions 12 and 14 contain latch-mounting sections or members 40 operative for external mounting of latches 30 having collar members 34. As illustrated in FIGS. 1 and 3 the latch 30 is mounted on the upstanding latch mounting section 40 such that the collar member 34 engages an alignment portion 41 of the end portion, which facilitates proper orientation of the latch 30. The socket housing latch-mounting sections or members 40 are preferably integrally formed out of the same insulative material as the housing 18. The locking members 25 include fingers 24 conformed for cooperative engagement with openings 23 on the memory module 70. When rotated in the groove 17 and latched against the locking member 25, the memory module 70 is rendered electrically communicative with the substrate or circuit board 80 upon which the socket 10 is mounted. For convenience of reference, a longitudinal axis is defined along the groove 17 and end portions 12 and 14, while a transverse axis is defined as being substantially orthogonal to the longitudinal axis and extending from the front to the back of the housing 18.

An exemplary end portion 12 of the socket 10 comprises a latch-mounting member or section 40 which is operative for mounting a cooperative latch member 30. Preferably, the latch-mounting section 40 contains opposing shoulders 41 and 43 to permit cooperative engagement with a latch collar member 34. The section 40 may be shaped as a protruding tower, post, mooring, pedestal or other exteriorly accessible structure for convenient latch mounting or removal. The latch-mounting section 40 may also have a variety of cross-sectional shapes to access a cooperatively shaped latch collar member 34, which may be press fit, snapped, clasped, or otherwise mounted thereon.

The end portion 12 includes at least one locking member 25 which prevents further rotation of the memory module 70 which has been inserted into the groove 17 then rotated into latched position. As seen in FIG. 2, the locking member 25 is conformed to provide a relief against which a latch 30 is resiliently disposed and to provide cooperative engagement with and between the memory module 70 and detent 32. The member 25 may be shaped as a vertical tower or arm containing a lateral protrusion or finger 24 operative to engage with a corresponding opening 23 (See FIG. 1) on the memory module 70. The locking member 25 further defines a groove or channel 27 conformed to cooperatively engage with an anti-stress tab 33 on the latch 30 so as to limit the movement or travel of the latch member 30 and to limit the stress placed upon the latch. A variety of locking member constructions, shapes, and sizes are possible depending upon the shape of the memory module or other substrate to be accommodated.

An abutment member 22 is located adjacent to the collar mounting member 40 to prevent bending or twisting of a latch 30 when a memory module 70 is urged into latching position against a locking member 25. The abutment member 22 has an upper portion spaced from the latch mounting member 40 so as to avoid interfering with latch installation or removal.

The end portion 12 also provides a solid foundation for posts 44 used in mounting the socket housing 18 onto a substrate 80, as well as for mounting a male key 50 and female keyway 52, elements which are known in the art.

An exemplary latch member 30, as shown in FIG. 2, is preferably formed from a unitary piece of resilient material, such as a continuous piece of metal. The latch includes a detent member 32 for clasping a memory module 70. The detent member 32 includes an anti-stress tab 33 conformed for cooperative engagement with a channel or groove 27 located in a housing socket locking member 25 to limit movement or bending of the latch 30. The latch also includes a collar member 34, which cooperatively mates with a collar-shaped latch-mounting member 40 of the socket housing 18 and preferably has a compliant C-shape section having opposing ends 35 to permit exterior mounting or press-fitting of the latch 30 onto the latch-receiving member 40. A resilient section 36 or arm, connecting the detent member 32 and collar member 34, biases the detent member 32 towards the locking member 25 of the housing and is preferably elongated and curved to provide the intended degree of resilience. The latch 30 and associated end portion 12 of FIG. 2 are shown in mated combination in FIG. 3.

Figure 3A:
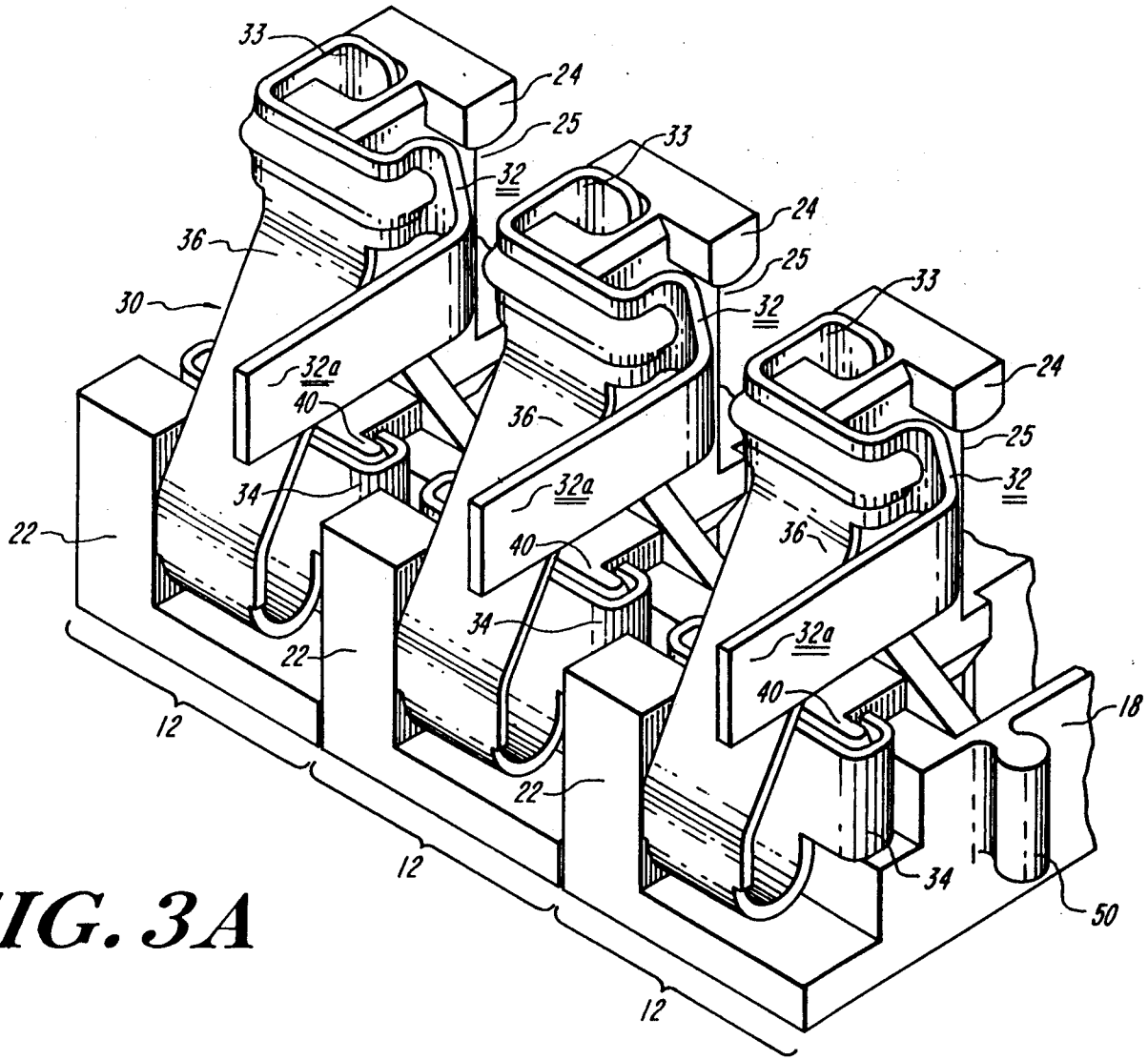
FIGS. 3*a* and 3*b* are perspective views of exemplary latches externally mounted upon end portions of coupled sockets.

FIG. 3*a* shows an exemplary embodiment of latches 30 exteriorly mounted on end portions 12 of socket housings 18 which have been coupled or ganged together by keys 50. The latch detent member 32 further comprises an elongated arm 32*a* operative to facilitate manual accessability to, and manipulation of, the detent member 32 at a distance from the portion of the detent member 32 which comes into clasping contact with a memory module or other substrate. The insertion and removal of memory modules or other inserted boards, as well as the insertion and removal of latches, are thereby facilitated, while the need to create access space by decoupling adjacent socket housings 18 or dismounting them from a common substrate is avoided.

Figure 3B:
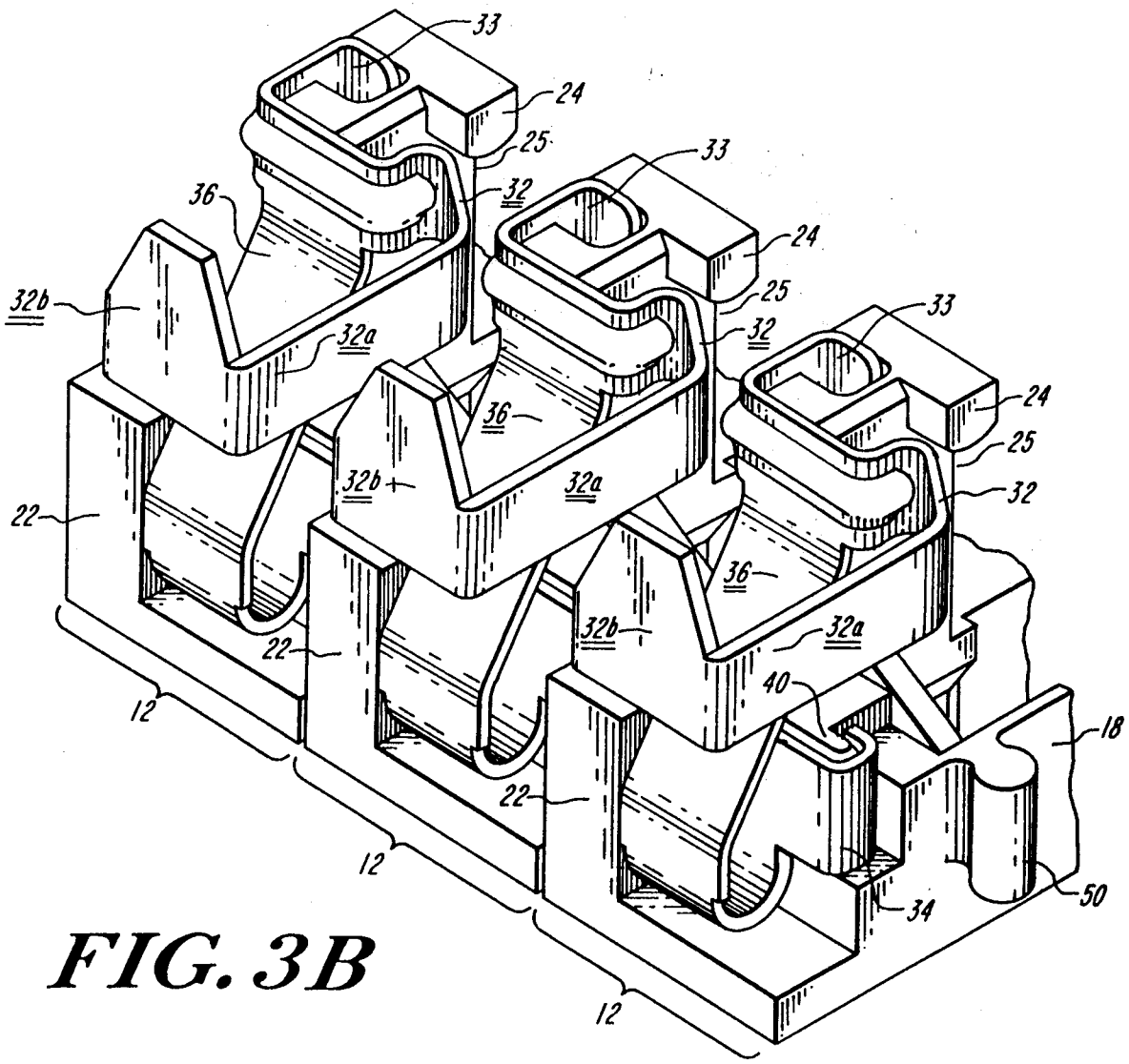

FIG. 3*b* shows another exemplary embodiment of latches 30 having elongated arms 32*a* and further comprising tabs 32*b* operative to permit manipulation of the detent member 32 in a number of directions. The tabs 32*b* provide manual accessibility such that the detent member 32 may be pulled away from its latched position against the locking member 25, and such that the latch 30 may be vertically mounted upon or dismounted from the latch-receiving section or member 40. The invention thus provides a variety of exteriorly mounted latch configurations which, even where socket housings are coupled together in close proximity, readily permit manipulation of the detent member and facilitate insertion and removal of latches and substrates such as memory modules.

Figure 4:
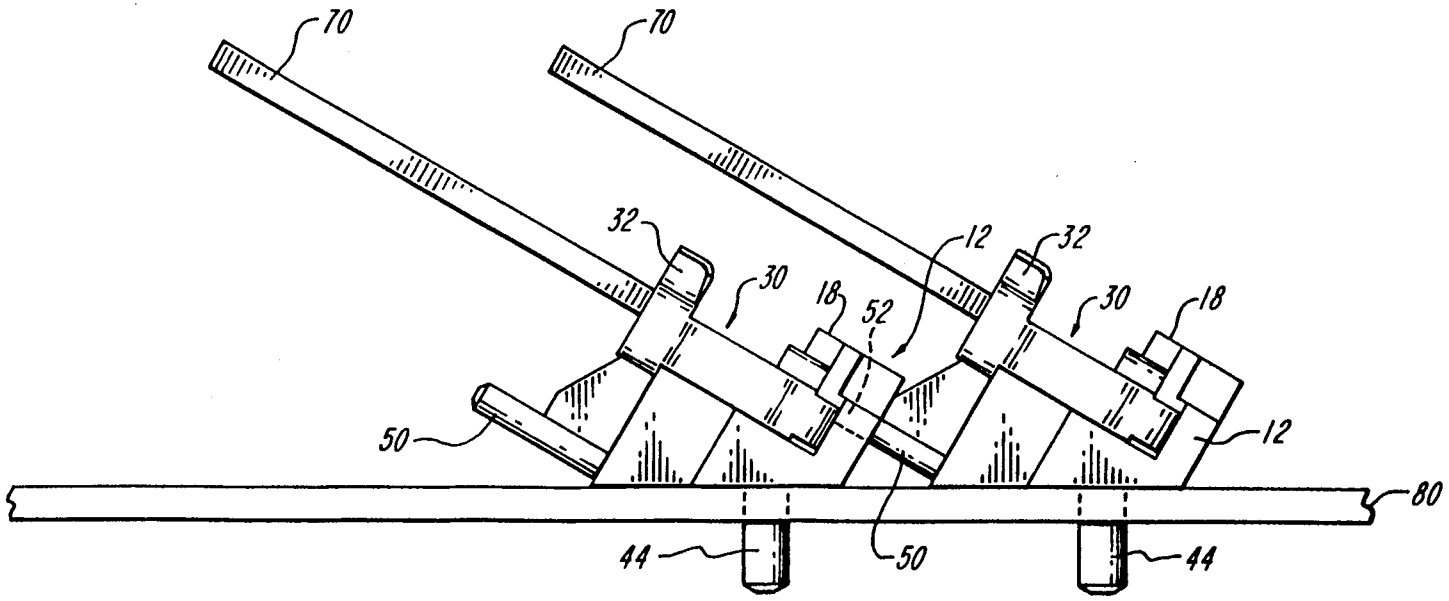
FIG. 4 is a side view of two low-profile versions of the socket of FIG. 1 key-locked together.
Figure 5:
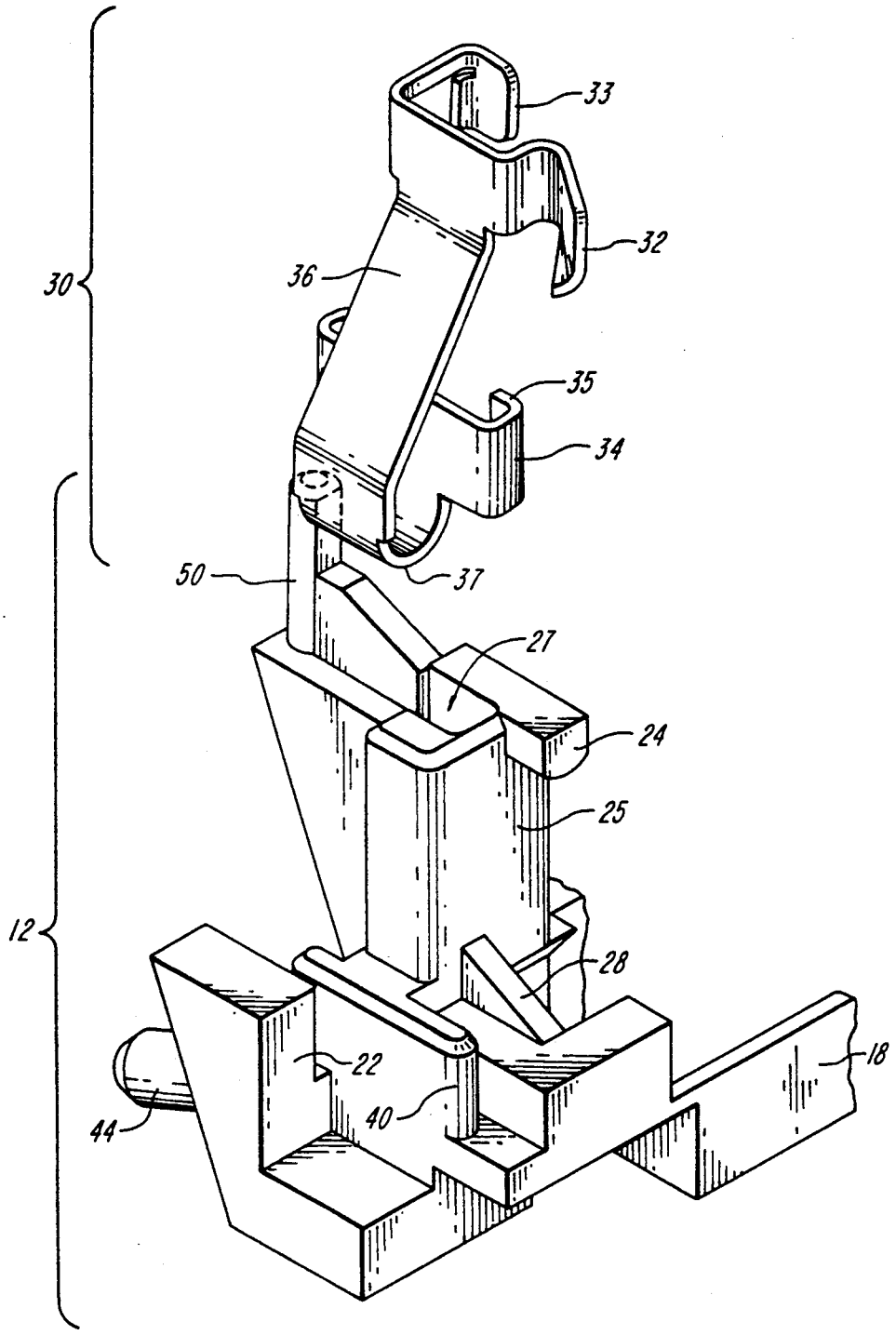
FIG. 5 is an exploded view of an end portion and associated socket of FIG. 4.

FIG. 4 shows two low-profile versions of the socket housings of FIG. 1 keylocked together at an angle on a common substrate 80. Other embodiments shown throughout herein mate similarly but assume an essentially vertical orientation when key-locked together. Substrate mounting posts 44 are attached at an angle to the end portions 12. The end portions 12 are connected together by male keys 50 mounted at the top of the end portion 12 and disposed within female keyways 52 located in the bottom of the housing 18. An exploded view of a socket end portion and associated latch are shown in FIG. 5.

Figure 6:
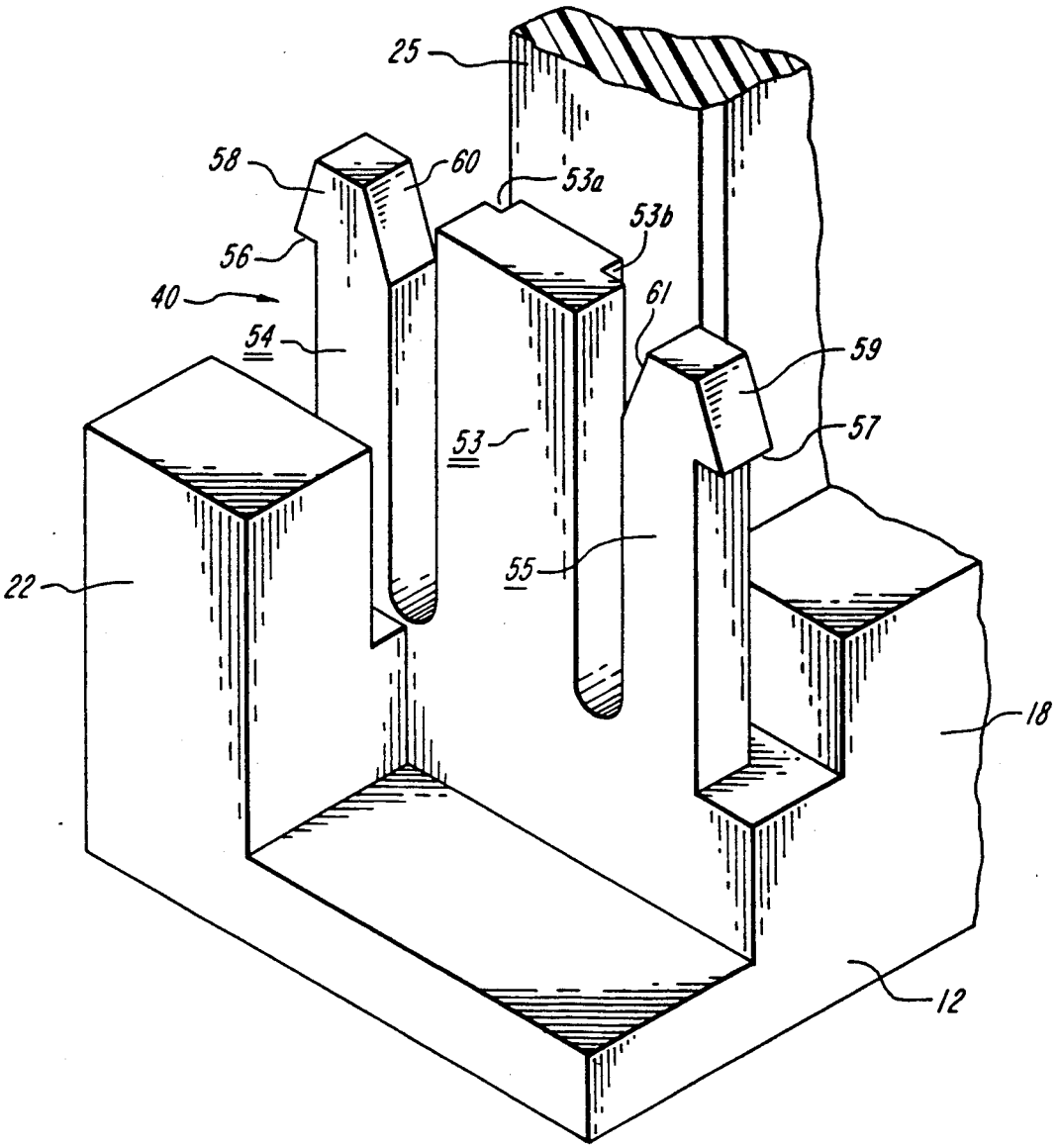
FIG. 6 is a perspective view of a socket housing latch-mounting member in another embodiment of the invention.
Figure 7:
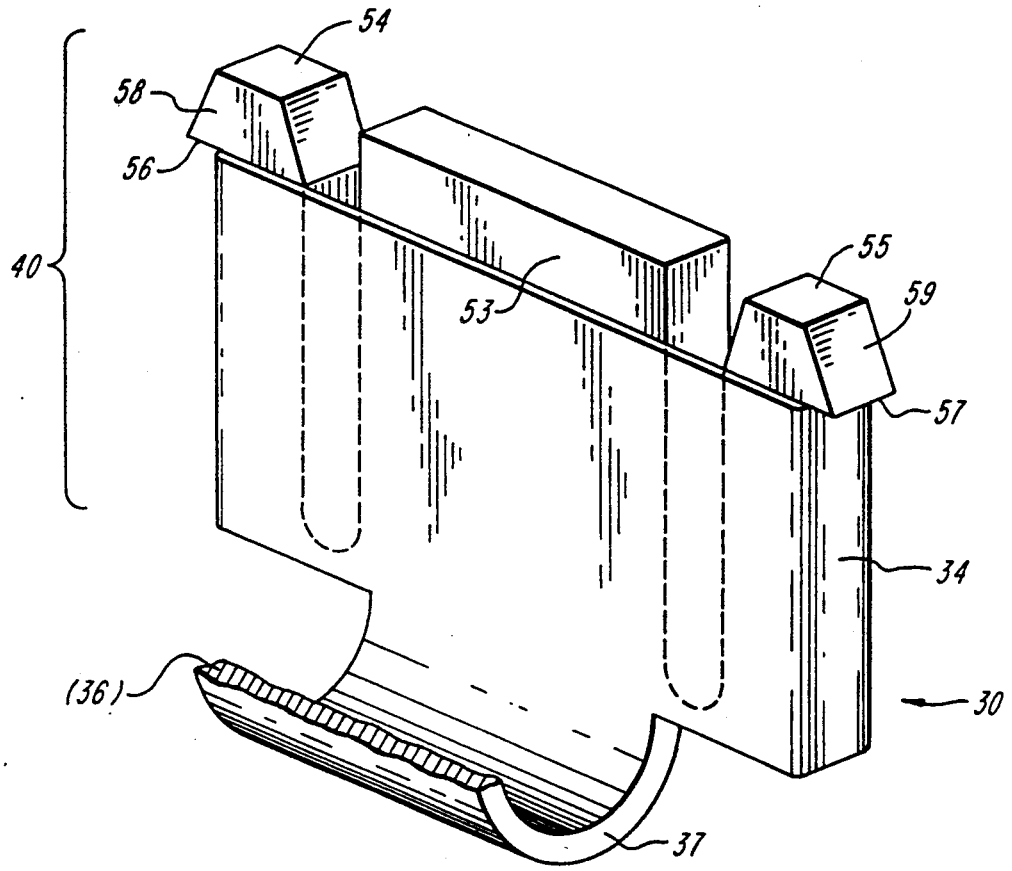
FIG. 7 is a partial view of the latch mounting member of FIG. 6 and associated latch collar member.

FIG. 6 is an exploded view of an end portion 12 in a further exemplary embodiment of the invention. The latch mounting section or member 40 includes prongs 54 and 55 having detents 56 and 57 conformed for cooperatively receiving and locking a latch collar member. Numerous variations of the pronged retaining member principle are possible within the scope of the invention. The prongs 54 and 55, which are preferably integrally molded with the socket housing and of sufficient longation for purposes of providing resilience, contain head portions 58 and 59 conformed for receivably locking a latch collar member slipped downwards over the head portions 58 and 59 and locked against the socket housing 18 by detent-shaped clasps 56 and 57. Head portions 58 and 59 further include sloped surfaces 60 and 61 to permit bending of the prongs 54 and 55 towards an intermediate column 53 sufficient to allow slidable insertion of collar member 34. The intermediate column contains indentations 53*a* and 53*b* corresponding to and for accommodation of the opposing ends of latch collar member 34. As shown in FIG. 7, the latch collar member 34 is secured by detent-shaped clasps 56 and 57. The collar member 34 may be dismounted from the collar-mounting member or section 40 simply by pushing the prong head portions 58 and 59 towards each other.

Figure 8:
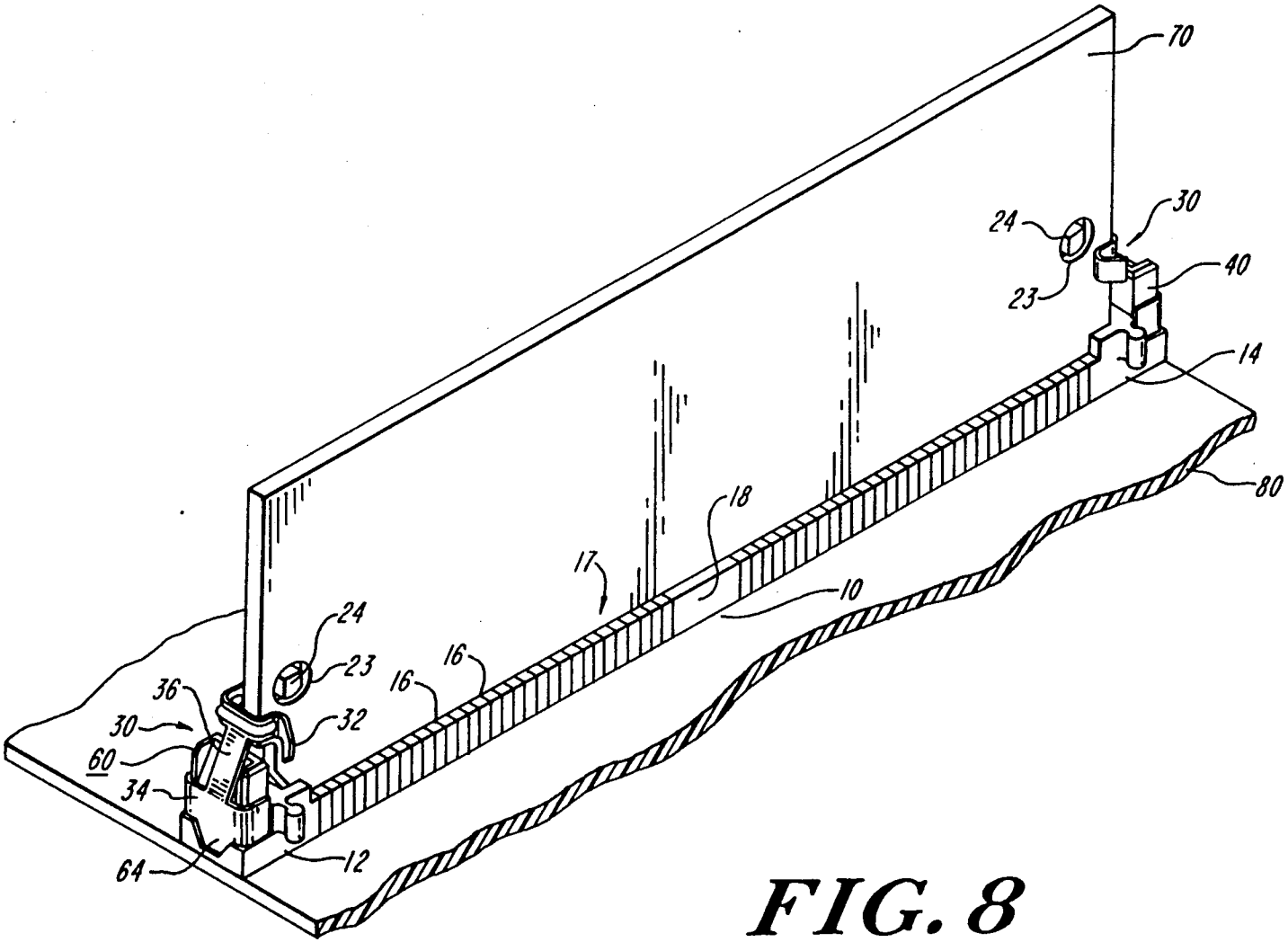
FIG. 8 is a pictorial view of a socket in another exemplary embodiment of the invention.
Figure 9:
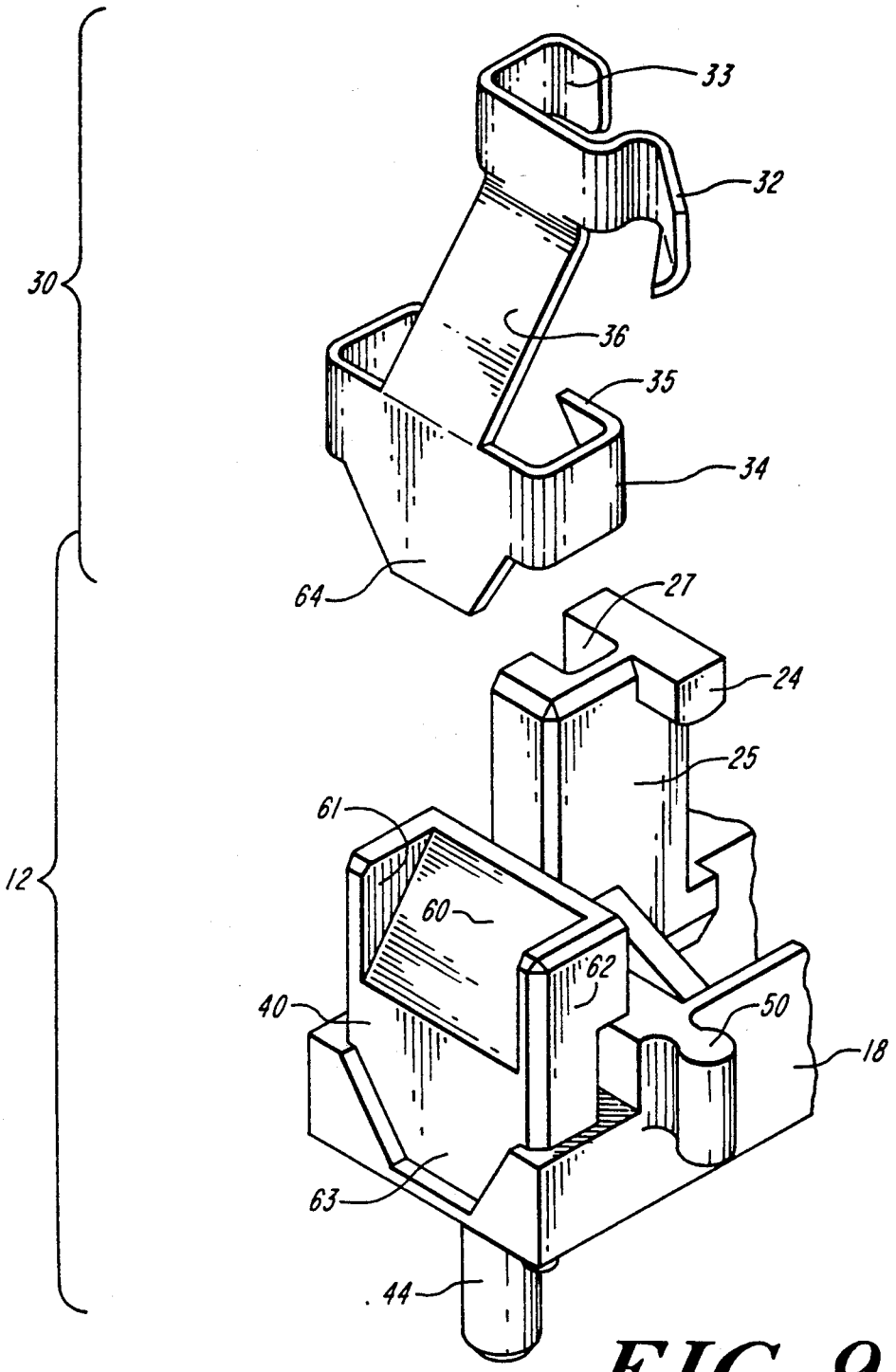
FIG. 9 is an exploded view of the socket end portion and associated latch of FIG. 8.

Other end portion configurations and associated latches are within contemplation of the present invention. Alternative versions are shown in FIGS. 8 through 11. As shown in FIG. 8, the latch member 30 may be conformed so as to be exteriorly mounted at the extreme end of the socket housing 18, thereby conserving space. The resilient arm 36 of the latch 30 joins the top part of the collar member 34. As shown in FIG. 9, a heightened protrusion or raised section or structure 60 which is preferably molded integrally atop of the latch-mounting section or member 40 contains lateral upstanding portions 61 and 62 sized to allow disposition and flexure of the resilient arm 36 of the latch 30. In addition, an orientation or anti-overstress tab 64 on the latch 30, conformed for cooperative engagement with a tab guide 63, facilitates exterior mounting of the latch 30.

Figure 11:
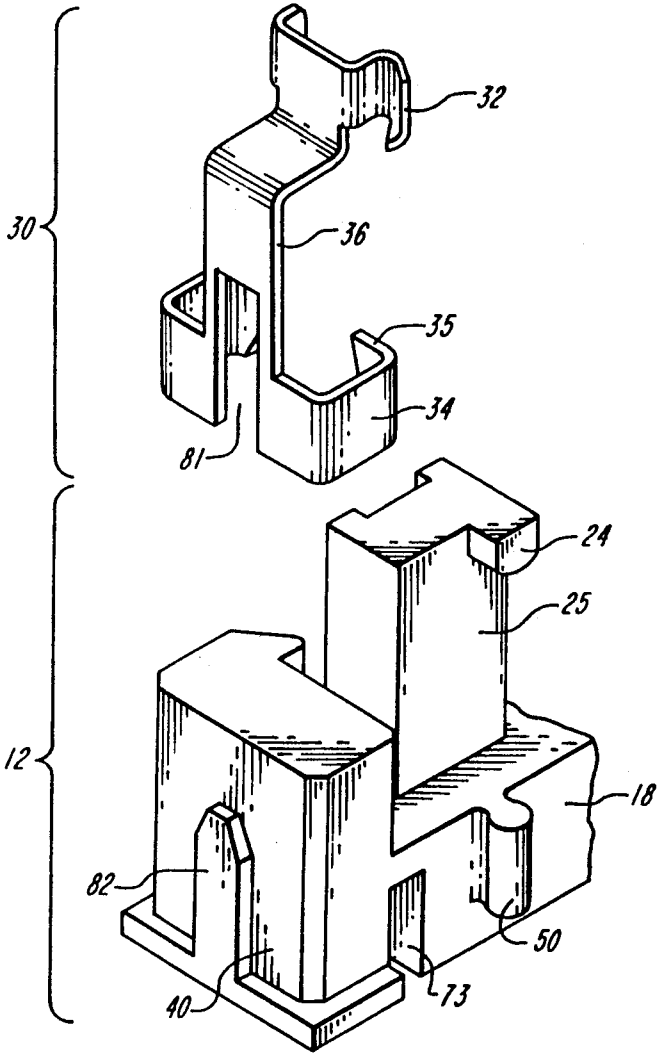
FIG. 10 and 11 are exploded views of socket end portions and associated latches in further embodiments of the invention.
Figure 10:
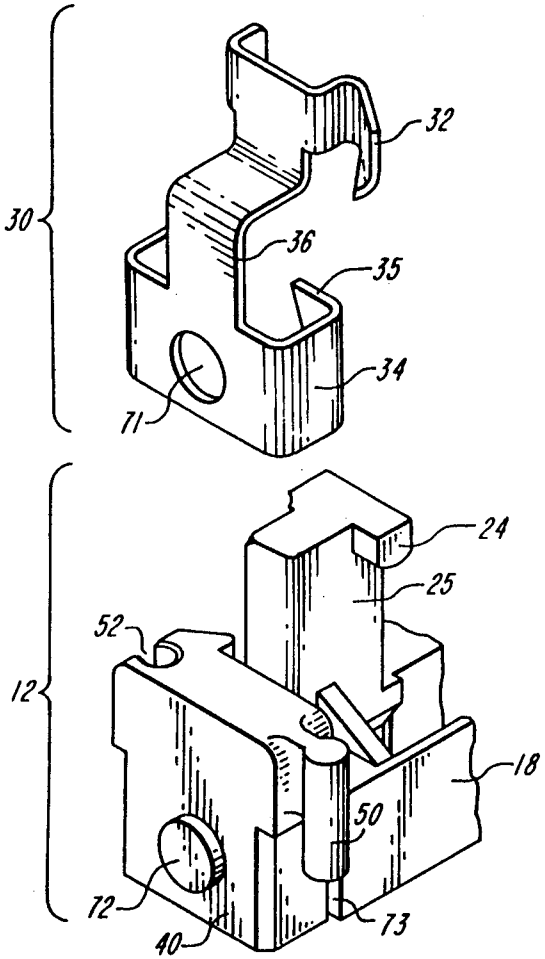

In further exemplary embodiments, orientation guides facilitate positioning of the latch exteriorly on the socket end portion. As shown in FIG. 10, a protruding circular post 72 on the socket end portion 12 is conformed for cooperative engagement with a circular guide opening 71 on the associated latch collar member 34; while in FIG. 11 a protruding elongated slot 82 is conformed for slidable mating with a correspondingly shaped guide slot 81 on the associated latch collar member 34. FIGS. 10 and 11 show collar receiving slots 73, disposed on the socket housing 18, corresponding to opposed ends 35 of the latch collar members 34. The collar members 34 contain ramped ends 35 operative to facilitate downward installation of the collar 30 and to engage with the corresponding slots 73.

It will be known to those skilled in the art that modifications of the invention can be practiced within the spirit of the invention. Accordingly, the scope of the invention is limited only by the scope of the claims.

We claim:

1. A socket for receiving a substrate comprising:

a housing having end portion, slots disposed between said end portions containing electrical contacts for establishing electrical communication with corresponding contacts arrayed edgewise on a substrate, a groove intersecting said slots and disposed on said housing for receiving the substrate and permitting the substrate to be rotated into a fixed position, and an external mounting section disposed exteriorly on at least one of said end portions, said external mounting section having an exterior mounting surface and at least one latch member detachably mounted upon said external mounting section, said at least one latch member having a base portion with an inward facing surface and being mounted upon said external mounting section with said inward facing surface in abutment with at least a portion of said exterior mounting surface of said external mounting section, said at least one latch member comprising a detent member operative to retain the substrate in a fixed position, a mounting member operative to mount said at least one latch member exteriorly upon at least a portion of said external mounting section, and a resilient section connecting said detent member and said mounting member and operative to bias said detent member against a substrate which has been rotated into fixed position on said housing, said resilient section including a substantially J-shaped portion disposed between said base portion and said detent member, said substantially J-shaped portion originating proximate to said upstanding mounting member and extending downwardly and outwardly therefrom to an upwardly extending portion which terminates at said detent member and said base portion including a portion wrapping at least partially around said exterior upstanding mounting surface.

2. The socket of claim 1 wherein said latch member is press-fit onto one of said housing end portions.

3. The socket of claim 1 wherein said latch member is snapped onto one of said housing end portions.

4. The socket of claim 1 wherein said latch member is comprised of resilient material.

5. The socket of claim 1 wherein said latch member is comprised of a unitary material.

6. The socket of claim 1 wherein said latch member is comprised of metal.

7. The socket of claim 1 wherein said latch member is removable from the end portion of said socket housing.

8. The socket of claim 1 wherein said mounting member on said latch member further comprises an antistress tab disposed on said mounting member opposite to where said resilient section connects said mounting member.

9. The socket of claim 1 wherein said end portions of said housing are comprised of substantially non-resilient material.

10. The socket of claim 1 wherein said mounting section of said housing is integrally formed with said socket housing.

11. The socket of claim 1 wherein said mounting member of said latch member further comprises two opposed ends operative to cooperatively engage said mounting member.

12. The socket of claim 1 wherein said housing end portion further comprises an abutment member for preventing bending of said latch member in at least one direction.

13. The socket of claim 1 wherein said housing end portion further comprises a raised section on the mounting section of said end portion, and said raised section being operative to accommodate the resilient section of the latch member.

14. The socket of claim 1 wherein said housing end portions further comprise a circular protruding member and said latch member further comprises a guide hole correspondingly shaped to said protruding member and operative to position said latch member onto said end portion.

15. The socket of claim 1 wherein said housing end portions further comprise an elongated protruding member and said latch member further comprises a guide slot correspondingly shaped to said protruding member and operative to position said latch member onto said end portion.

16. The socket of claim 1 wherein said means for mounting said latch member exteriorly on said socket housing comprises a collar member.

17. The socket of claim 16 wherein said collar member comprises a compliant section.

18. The socket of claim 16 wherein said collar member is perpendicularly disposed with respect to said resilient section of said latch member.

19. The socket of claim 1 wherein said latch detent member further comprises an elongated arm operative for manual actuation to move said detent member to an unlatched position.

20. The socket of claim 19 wherein said elongated arm further comprises a tab operative for manual actuation to move said detent member to an unlatched position.

21. The socket of claim 1 wherein said mounting section of said socket housing further comprises at least one resilient prong operative to engage said mounting member of said latch member.

22. The socket of claim 21 wherein said resilient prong further includes a detent for locking said mounting member of said latch member.

23. The socket of claim 1 further comprising at least one locking member located on one of said end portions and operative for retaining in a fixed position a substrate inserted in said groove and rotated against said locking member.

24. The socket of claim 23 wherein said locking member further comprises a finger operative for engagement with a portion of a substrate inserted in said groove and rotated against said locking member.

25. A socket for receiving a substrate comprising:

a housing having two end portion, a groove disposed between said end portions for inserting a substrate and rotating it to a fixed position, at least one locking member disposed at one of said end portions and operative to retain a substrate which has been rotated into fixed position, and a channel disposed in said locking member; and an externally exposed latch member exteriorly and detachably mounted upon one of said end portions, said externally exposed latch member having a detent member for retaining a substrate in fixed position against said locking member, and having a base portion attachable to at least one of said end portions and a resilient section, said resilient section including a substantially J-shaped portion disposed between said base portion and said detent member, said substantially J-shaped portion originating proximate to said base portion and extending downwardly and outwardly therefrom to an upwardly extending portion which terminates at said detent member, said detent member having an anti-overstress tab conformed for placement in said channel on said locking arm, said tab operative thereby to limit the movement of said externally exposed latch member along a longitudinal axis of said housing.

26. A latch for exterior mounting upon a socket housing, comprising:

a detent member operative for retaining a substrate inserted in the socket housing and rotated to a fixed position;

an exteriorly exposed mounting member operative to permit external and detachable mounting of the latch member onto the socket housing; and a resilient section connecting said detent member and said exteriorly exposed mounting member and operative to bias said detent member against a substrate rotated into a fixed position adjacent said detent member, said resilient section including a substantially J-shaped portion disposed between said exteriorly exposed upstanding mounting member and said detent member, said substantially J-shaped portion originating proximate to said exteriorly exposed upstanding mounting member and extending downwardly and outwardly therefrom to an upwardly extending portion which terminates at said detent member.

27. The latch of claim 26 further comprising an elongated arm disposed on said detent member and operative for manual actuation to move said detent member to an unlatched position.

28. The latch of claim 27 further comprising a tab disposed on said elongated arm and operative for manual actuation to move said detent member to an unlatched position.

29. A socket housing for receiving a substrate, comprising:

a housing having end portions, a groove disposed between said end portions and containing an array of contacts for establishing electrical contact with respective contacts arrayed on the edge of a substrate to be inserted into said groove and rotated to a fixed position, and an exterior mounting section located on one of said end portions and operative to externally and detachably mount an exteriorly exposed latch member having a collar portion, a resilient portion and a latching portion thereon, said exterior mounting section having an upstanding latch mounting member including a protruding member accepting said collar portion and an alignment member disposed intermediate to said groove and said resilient portion of said latch member.

30. The socket of claim 29 further comprising a housing having substantially rigid and non-resilient end portions.

31. A single in-line memory module socket comprising:

a housing having a pair of end portions, a groove disposed between said end portions for accepting a memory module rotatable therein to a fixed position, at least one of said end portions having an externally exposed mounting section; and a detachable latch member exteriorly and detachably mounted on the externally exposed mounting section of said end portion, said detachable latch member having a collar engageable with said externally exposed mounting section, a detent member operative to retain the memory module in a fixed position and a resilient portion connecting said collar and said detent member, said latch member being manually movable to release the memory module for removal from the socket, and said externally exposed upstanding mounting section having a latch mounting member including a protruding member accepting said collar portion and an alignment member disposed intermediate to said groove and said resilient portion of said latch member.

32. The socket of claim 31 wherein the latch member is of unitary metal construction.

33. The socket of claim 31 wherein the latch member includes a mounting section exteriorly attachable to the mounting section of the end portion of the housing.

34. The socket of claim 31 wherein the latch member includes a resilient section interconnecting the mounting section and the detent member and operative to provide movement of the detent member along the longitudinal axis of the housing.

35. The socket of claim 31 wherein the mounting section of the housing includes a raised pedestal configured to exteriorly receive a mounting portion of the latch member.

36. A detachable latch for mounting on a socket having an exteriorly disposed mounting section, comprising:

an external mounting member operative to mount the latch exteriorly and detachably on the exteriorly disposed mounting section of said socket;

a detent member operative to retain a substrate on the socket;

a resilient section connecting said external mounting member and said detent member and operative to bias said external mounting member against the substrate; and said detent member having an elongated arm operative for manual actuation to move said detent member into an unlatched position, and said exteriorly disposed upstanding mounting section including a protruding member accepting said external mounting member and an alignment member disposed intermediate to said groove and said resilient section of said latch member.

37. The latch of claim 36 wherein said elongated arm includes a tab operative for manual actuation to move said detent member into the unlatched position.

38. A socket for receiving a substrate comprising:

a housing having end portions, slots disposed between said end portions containing electrical contacts for establishing electrical communication with corresponding contacts arrayed edgewise on a substrate, a groove intersecting said slots and disposed on said housing for receiving the substrate and permitting the substrate to be rotated into a fixed position, and an external mounting section disposed exteriorly on at least one of said end portions, said external mounting section having an exterior mounting surface and an alignment portion disposed intermediate to said groove and said exterior mounting surface; and at least one latch member detachably mounted upon said external mounting section, said at least one latch member having a base portion with an inward facing surface and being mounted upon said external mounting section with said inward facing surface in abutment with at least a portion of said alignment portion and said exterior mounting surface of said external mounting section, said at least one latch member comprising a detent member operative to retain the substrate in a fixed position, an upstanding mounting member operative to mount said at least one latch member exteriorly upon at least a portion of said external mounting section, and a resilient section connecting said detent member and said mounting member and operative to bias said detent member against a substrate which has been rotated into fixed position on said housing, said resilient section including a substantially J-shaped portion disposed between said base portion and said detent member, said substantially J-shaped portion originating proximate to said mounting member and extending downwardly and outwardly therefrom to an upwardly extending portion which terminates at said detent member.

39. The socket of claim 38 wherein said end portions comprises a stepped configuration wherein said exterior mounting surface and said base portion are disposed on an intermediate step of said socket.

40. The socket of claim 38 wherein said end portions include one of a key and a key-way for engagement with another of a key and a key-way disposed on a second socket mechanically coupled to said socket.

41. The socket of claim 38 wherein said external mounting section includes prongs having detents conformed for detachably receiving said base portion of said at least one latch member.

* * * * *